US011857012B2

(12) United States Patent
Menotti

(10) Patent No.: US 11,857,012 B2
(45) Date of Patent: Jan. 2, 2024

(54) MAGNETIC HAIR ACCESSORY AND METHOD

(71) Applicant: Scandinavian Hair Systems, Inc., Chicago, IL (US)

(72) Inventor: Mette Menotti, Chicago, IL (US)

(73) Assignee: Scandinavian Hair Systems, Inc., Chicago, IL (US)

( * ) Notice: Subject to any disclaimer, the term of this patent is extended or adjusted under 35 U.S.C. 154(b) by 7 days.

(21) Appl. No.: 16/366,828

(22) Filed: Mar. 27, 2019

(65) Prior Publication Data

US 2020/0305529 A1 Oct. 1, 2020

(51) Int. Cl.
*A41G 5/00* (2006.01)

(52) U.S. Cl.
CPC ..... *A41G 5/0053* (2013.01); *A41G 5/0013* (2013.01); *A41G 5/0086* (2013.01)

(58) Field of Classification Search
CPC ..... A41G 5/00; A41G 5/0006; A41G 5/004; A41G 5/0053; A41G 5/0013; A41G 5/0086; A41G 5/0026; A41G 5/0073; A41G 5/0093; A41G 5/02; A41G 3/00; A41G 3/0008; A41G 3/0033; A41G 3/0066
USPC ..... 132/53, 201
See application file for complete search history.

(56) References Cited

U.S. PATENT DOCUMENTS 3,516,422 A 6/1970 Bechtold et al.
3,662,766 A 5/1972 Maassen et al.
5,741,336 A * 4/1998 Fraser ..... A41G 3/0033 132/53
8,061,367 B2 11/2011 Rabe et al.
9,192,550 B2 11/2015 Fleissman et al.
2005/0252518 A1* 11/2005 Salinas ..... A41G 5/004 132/201
2006/0204702 A1 9/2006 Thevenet
2016/0206031 A1* 7/2016 Stoka ..... A41G 5/02
2019/0068008 A1* 2/2019 Gao ..... H01F 7/0278
2019/0090567 A1* 3/2019 Johnson ..... A01K 13/00
2019/0216152 A1* 7/2019 Francis ..... A41G 5/0073
2019/0246729 A1* 8/2019 Nicoline ..... A61K 8/19
2019/0254372 A1* 8/2019 Rigby ..... A41G 5/0053
2019/0261715 A1* 8/2019 Hunter ..... A61K 8/19
2019/0373973 A1* 12/2019 Richwine ..... A41G 5/0053

OTHER PUBLICATIONS

"Temperature Effects on Alnico Magnets." Bunting—EMagnets, Bunting, Jul. 23, 2020, e-magnetsuk.com/alnico-magnets/temperature-ratings/. (Year: 2020).*

Amazon, Ultra Long Magnetic False Eyelashes, Feb. 19, 2018, URL: https://www.amazon.com/Ultra-Long-Magnetic-False-Eyelashes/dp/B076H2FGL2, US.

* cited by examiner

*Primary Examiner* — Rachel R Steitz
(74) *Attorney, Agent, or Firm* — Nyman IP LLC; Scott Nyman

(57) ABSTRACT

A hair accessory is provided for supplementing and/or replacing hair using a magnetic installation techniques. The magnetic hair accessory may include hair material, magnetic material, a coating, an active face, a neutral face, a score, top piece and/or magnetic band. A method for supplementing and/or replacing hair using a magnetic hair accessory is also provided.

18 Claims, 5 Drawing Sheets

MAGNETIC HAIR ACCESSORY AND METHOD

FIELD OF THE INVENTION

The present disclosure relates to a magnetic hair accessory. More particularly, the disclosure relates to supplementing and/or replacing hair using a magnetic hair accessory.

BACKGROUND

Supplemental hair installations and extensions have been in practice for much of recorded human history. In ancient Egyptian times, dating back further than 3,000 BCE, wigs and extensions were believed to be worn as forms of adornment for the socially elite and as protection from sunlight. In the 17th century, wigs were fashionable to portray an elegant appearance. In modern times, hair extension and replacement procedures are desired to supplement or replace short, thinning, or lost hair. Some common hair supplementing techniques used today include clip-ons, bonding, adhering or fusion, netting, lacing, weaving, braiding, and wearing wigs. However, some of these hair supplementing techniques lack a natural appearance. Additionally, current techniques for attachment and durability of installation are insufficient, often causing detachment of installed hair pieces, irritation from tapes and adhesives, discomfort, breakage of a user's real hair, and other issues. Other hair supplementing techniques may provide enhanced natural appearances but typically require labor-intensive installation procedures.

Additionally, some hair supplementing techniques that are easy to install, such as clip-ons or wigs, lack the durability and workability of original hair. These incomplete solutions often leave wearers unable to approximate fully styling and handling their hair as if it were originally grown by the wearer. No known solution exists that can provide a natural looking appearance while retaining a relatively easy installation, removal, and reattachment procedure.

Therefore, a need exists to solve the deficiencies present in the prior art. What is needed is a hair accessory to supplement thinning or balding hair. What is needed is a hair accessory that is easily installable. What is needed is a hair accessory that is magnetically installable to a wearer. What is needed is a magnetic hair accessory that is corrosion resistant. What is needed is a magnetic hair accessory that is securely installable and removable. What is needed is a method for installing a magnetic hair accessory.

SUMMARY

An aspect of the disclosure advantageously provides a hair accessory to supplement thinning or balding hair. An aspect of the disclosure advantageously provides a hair accessory that is easily installable. An aspect of the disclosure advantageously provides a hair accessory that is magnetically installable to a wearer. An aspect of the disclosure advantageously provides a magnetic hair accessory that is corrosion resistant. An aspect of the disclosure advantageously provides a magnetic hair accessory that is securely installable and removable. An aspect of the disclosure advantageously provides a method for installing a magnetic hair accessory.

This disclosure generally relates to an accessory for extending length, filling in areas of thinning or balding, or creating volume to a wearer's hair. The hair accessory device may be installable on a portion of a wearer, for example, a wearer's head, to provide hair extensions. The hair accessory device may include magnetic material to assist with installing the extension on a wearer. The hair accessory may replace the use of adhesives, tapes, clips, hook-and-loop fasteners, links, tread and braids, and other undesirable hair attachment techniques presently in use.

A hair accessory enabled by this disclosure may include hair material, an installation component, and optionally an attachment interface. The hair material may include one or more strands of hair, for example, top-pieces, wigs, hair extensions, and/or any other type of non-medical hair replacements. The strands of hair may include human hair, animal hair, synthetic hair, or otherwise formed hair.

A hair accessory enabled by this disclosure may additionally include an installation component to install the hair accessory device on a wearer. The installation component may include magnetic material to facilitate installation of the hair accessory. The magnetic material may be flexible, strong, and small. The magnetic material may include rare-earth magnets. The magnetic material may include a coating and/or rubber layer to resist corrosion.

In one embodiment, the magnetic material may be incorporated into and/or near the hair material, for example, at a base end of the hair material. In another embodiment, the installation component may include magnetic dust, and could be held by a strip or base, such as adhesive tape, which may be applied to the hair material. In another embodiment, the magnetic material may be provided in thin strips configurable to attract to one another. The installation component may be installed and/or uninstalled with a tool. The installation component may be removably installed on a wearer.

For embodiments where the magnetic material of the installation component is not incorporated near the hair material, the hair accessory device may include an attachment interface to connect the length of hair and the installation component. The attachment interface may use adhesive, welding, tape, clips, stitching, or another attachment technique to connect the length of hair and the installation component.

An illustrative method is provided within this disclosure to install the hair accessory on a wearer. In one example with magnetic material incorporated near the hair material, the hair accessory may be installed by locating the lengths of hair material near other lengths of hair material. The lengths may secure itself to natural hair or another anchor or mounting location through magnetic attraction. In another example, the installation component may be configured in strips that may be inserted in pockets around the hair system of a top-piece, wig attachments, or the attachment may cover substantially the entire inside of the hair piece. For extensions, the strips may be attached along the weft or be an actual part of the weft of the hair extensions or individual extensions, for example, using magnetic attraction.

In another embodiment, the method may provide direct attachment of the installation component featuring a magnet installed nearly directly to the skin. An adhesive material, for example, a medical grade tape, may be used on one side of the magnet to keep the magnet strip stable on the skin. Alternatively, the tape itself could be made with magnet "dust" and another magnet may be attached to the cranial wig. The methods provided with the invention could be applied further to attach top hair, beards, mustaches, eyebrows, and other areas of the body.

According to an embodiment of this disclosure, a hair accessory is provided including hair material, a magnetic material, and a coating. The hair material may include a hair material base end and a hair material distal end. The magnetic material may be operatively installed to the hair material near the hair material base end. The coating may at least partially enclose the magnetic material. The hair material may be installable to a mounting location via compression by the magnetic material onto the mounting location.

In another aspect, the magnetic material may include magnetic particles substantially located within the coating.

In another aspect, the magnetic material may include rare-earth magnets.

In another aspect, the magnetic material may include neodymium.

In another aspect, the magnetic material may include neodymium-iron-boron.

In another aspect, the magnetic material may further include cobalt. The magnetic material may be resistant to degradation for up to about 40 degrees Celsius.

In another aspect, the magnetic material may further include dysprosium.

In another aspect, the magnetic material may be at least partially bonded to an attachment interface.

In another aspect, the hair accessory may additionally include an active face magnetically attractable to at least one other active face to install the hair material to the mounting location via at least compression.

In another aspect, the hair accessory may further include a neutral face positioned approximately opposite to the active face and exhibiting minimal wandering flux.

In another aspect, the mounting location may include natural hair grown by a wearer.

In another aspect, the mounting location may include a base portion installable to a wearer.

In another aspect, the coating may include a reaction polymer. The coating may substantially enclose the magnetic material at the hair material base end.

In another aspect, the reaction polymer may include polyurethane.

In another aspect, the coating may include a score to improve friction and increase grip to the mounting location.

In another aspect, the hair material may include more than one hair strand.

According to an embodiment of this disclosure, a hair accessory is provided including hair material, a magnetic material including neodymium-iron-boron operatively installed to the hair material, a coating including a reaction polymer to substantially enclose the magnetic material, an active face, and a neutral face positioned approximately opposite to the active face. The active face may magnetically attract at least one other active face to install the hair material to a mounting location via at least compression. The neutral face may exhibit minimal wandering flux.

In another aspect, the magnetic material may further include cobalt and/or dysprosium. The reaction polymer may include polyurethane.

According to an embodiment of this disclosure, a method is provided for installing a hair accessory including hair material and a magnetic material. The method may include (a) positioning the hair material near a mounting location such that an active face with attractive magnetic characteristics substantially faces the mounting location. The method may also include (b) positioning at least one other active face near the active face to install the hair material to the mounting location. The method may further include (c) compressing the active face and the at least one other active face about the mounting location via the magnetic material operatively installed to the hair material, the magnetic material may include neodymium and being at least partially enclosed in a coating.

In another aspect, the method may further include (d) improving friction and increasing grip of the hair material to the mounting location via a score of the coating.

Terms and expressions used throughout this disclosure are to be interpreted broadly. Terms are intended to be understood respective to the definitions provided by this specification. Technical dictionaries and common meanings understood within the applicable art are intended to supplement these definitions. In instances where no suitable definition can be determined from the specification or technical dictionaries, such terms should be understood according to their plain and common meaning. However, any definitions provided by the specification will govern above all other sources.

Various objects, features, aspects, and advantages described by this disclosure will become more apparent from the following detailed description, along with the accompanying drawings in which like numerals represent like components.

DETAILED DESCRIPTION

Figure 2:
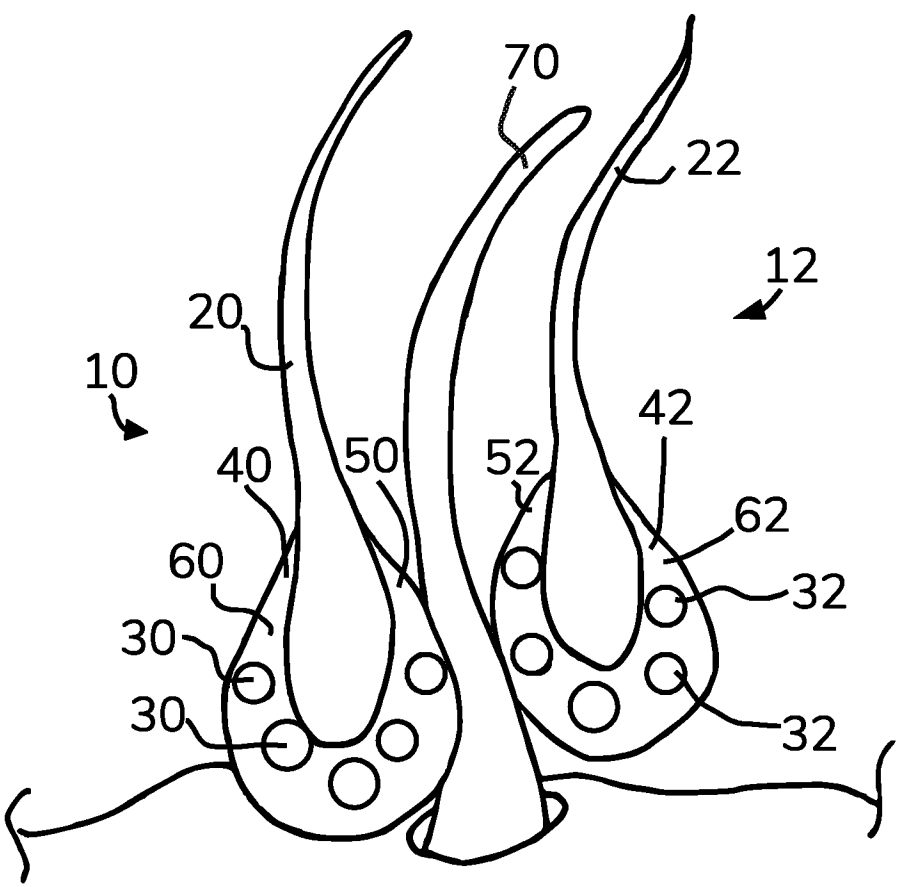
FIG. 2 is a front elevation view of a magnetic hair accessory installation, according to an embodiment of this disclosure.
Figure 1:
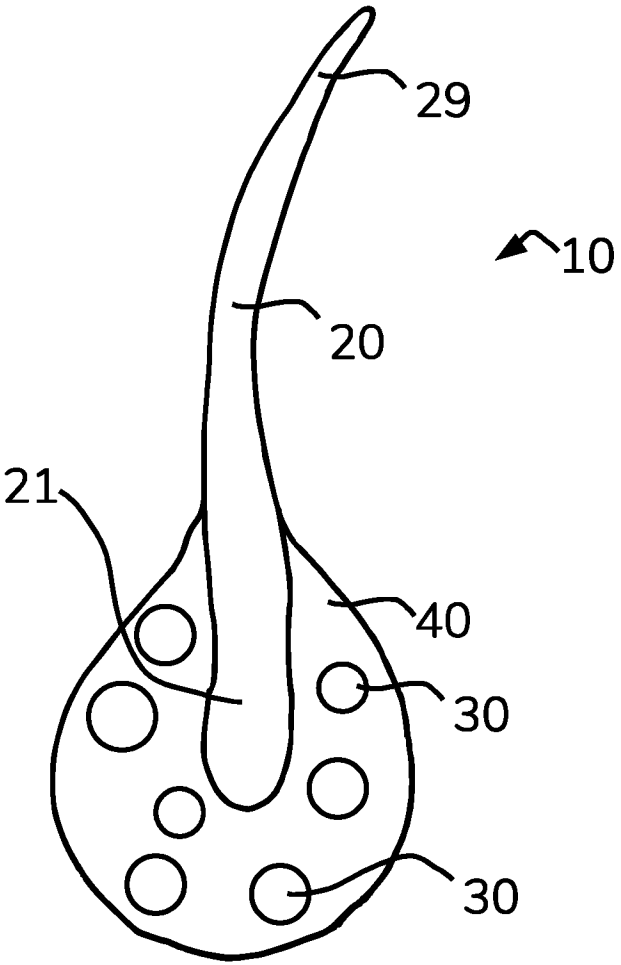
FIG. 1 is a front elevation view of a magnetic hair accessory, according to an embodiment of this disclosure.

The following disclosure is provided to describe various embodiments of a magnetic hair accessory. Skilled artisans will appreciate additional embodiments and uses of the present invention that extend beyond the examples of this disclosure. Terms included by any claim are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Various aspects of the present disclosure will now be described in detail, without limitation. In the following disclosure, a magnetic hair accessory will be discussed. Those of skill in the art will appreciate alternative labeling of the magnetic hair accessory as magnetic hair extensions, magnetic hair, hair, top piece, partials, wigs, extensions, frontals, hair replacement, the invention, or other similar names. Similarly, those of skill in the art will appreciate alternative labeling of the magnetic hair accessory as a hair supplemental technique, magnetic hair installation method, magnetic hair method, method, operation, the invention, or other similar names. Skilled readers should not view the inclusion of any alternative labels as limiting in any way.

Referring now to FIGS. 1-7, the magnetic hair accessory will now be discussed in more detail. The magnetic hair accessory 10 may include hair material 20, magnetic material 30, a coating 40, an active face 50, a neutral face 60, optional scoring 80, in some embodiments a top piece 90 and magnetic band 92, attachment interface, and additional components that will be discussed in greater detail below. The magnetic hair accessory may operate by including one or more of these components interactively with other components for supplementing and/or replacing hair using a magnetic hair accessory 10.

The hair material will now be discussed in greater detail. FIGS. 1-7 highlight examples of the hair material, which may also be shown in other figures. The hair material 20 may include a hair material base end 21, at which the hair material may be installable to a wearer. The hair material 20 may additionally include a hair material distal end 29, which may be opposite the hair material base end 21. The hair material distal end 29 of the hair material 20 may simulate the ends of natural hair.

For the purpose of this disclosure, hair material 20 is intended to include natural hair grown by a human or other animal, synthetic hair, manufactured hair, simulated human hair, and other hair-like materials that could be used to supplement or replace the hair of a wearer. Additionally, the term hair material is intended to include individual strands of hair, grouping of hair strands, or an alignment of hair for inclusion on an attachment interface or other device to assist with the installation of the hair material on a wearer.

As mentioned above, the hair material 20 may include natural hair. As will be appreciated by those of skill in the art, natural hair may describe a protein filament grown from the follicles of an animal's skin. Hair is commonly grown on mammals but can also be grown on other animals. Hair is typically aligned with a base end, from which natural hair may extend outwardly from a follicle, and a distal end or tip opposite the base end. As will be appreciated by those of skill in the art, natural hair can be grown with various colors, textures, thicknesses and other properties. These characteristics of natural hair may be influenced by the levels of melanin such as eumelanin or pheomelanin, keratin, and others.

The hair material 20 may also include synthetic hair, synthetic fibers, and other artificial hair compositions that will be appreciated by skilled artisans. Synthetic fibers may include materials that simulate natural hair without requiring the growth, cultivation, donation, or otherwise acquiring of human, animal, and/or other hair. Synthetic hair and/or fibers may be extruded at a diameter approximating the width of natural hair using materials intended to mimic the properties of natural hair. Synthetic hair may be produced using materials such as crudes, coal, limestone, water, and other materials. Semisynthetic hair may also be included, which may include for example plant-derived cellulose. In some embodiments, the hair material 20 may include a combination of natural, synthetic, semisynthetic, and/or other fibers.

The magnetic material will now be discussed in greater detail. FIGS. 1-7 highlight examples of the magnetic material, which may also be shown in other figures. The magnetic material 30 may be a single material or composition of materials that exhibit at least some magnetism. For the purpose of this disclosure, magnetism is considered to include the emission of magnetic fields from a material, which can act on other currents and magnetic energies. Magnetic materials 30 may include substances such as those derived from iron, nickel, cobalt, rare-earth materials, and other materials that would be appreciated by a person of skill in the art after having the benefit of this disclosure. Paramagnetic substances may also be included in some embodiments.

Magnetic materials 30 may include an attractive force that draw other magnetic materials and/or magnetically-receptive materials through the attractive properties of opposing magnetic poles. Magnetic materials 30 may be oriented or positioned such to have a surface exhibiting a desirably sufficient level of flux density, which may provide a magnetic field sufficient to attract other magnetic materials and other materials attracted by magnetic forces. The magnetic materials 30 may also be oriented or positioned such that a surface sufficiently mitigates the magnetic flux to a level where undesired magnetic attraction is reduced. For example, an orientation or positioning may allow one side to display attractive magnetic properties and an opposing side to display relatively neutral magnetic properties. The selective exposure to magnetic attraction may advantageously reduce the likelihood of bleed through when two pieces of magnetic material are sandwiched between the hair material 20. The selective exposure to magnetic attraction may also advantageously resist attraction of metal objects such as hair clips, bobby pins, and other magnetically attractable objects. The structure of the magnetic materials 30 and/or attachment interfaces onto which the magnetic materials 30 may be installed can be configured with matched pole magnetization to align multiple magnets with substantial elimination of repelling forces.

The magnetic material 30 may be provided as a collection of particles, for example, dust or powder, without limitation. The magnetic material 30 may be pliable. In some embodiments, the magnetic material 30 may be resistant to cracking, breaking, tearing, deteriorating, and otherwise being undesirably disfigured. The magnetic material 30 may be designed to conform to targeted applications, such as integration with the hair material 20.

The magnetic material 30 may include one or more rare-earth magnets, which may be provided in particle form or another form that would be appreciated by a person of skill in the art. Rare-earth materials may be desirable due to their strong magnetic flux density. Materials such as neodymium, praseodymium, dysprosium, samarium, terbium, holmium, and/or other materials may be included by the rare-earth materials, without limitation. The magnetic material 30 may be at least partially coated to resist corrosion or other undesired deterioration causable by exposure to the environment.

In at least one embodiment, the magnetic material 30 may include neodymium. For the purpose of this disclosure, the inclusion of neodymium in the magnetic material 30 is also intended to include neodymium alloys. Neodymium and other magnets may be provided in sintered, bonded, particle, and/or other forms. Magnetic properties of bonded neodymium magnets may be weaker compared with sintered neodymium, but may advantageously allow precise sizing, decreased brittleness, flexibility in molding and formation of complex shapes, greater control of magnetized directions, enhanced resistance against corrosion, light weight, and other benefits that will be apparent to a person of skill in the art after having the benefit of this disclosure.

In at least one embodiment, the magnetic material 30 may include neodymium-iron-boron, which is an alloy of neodymium. Neodymium-iron-boron may be represented by the chemical formula:

$$Nd_2Fe_{14}B$$

Magnetic material 30 including neodymium-iron-boron may include a tetragonal crystalline structure. The magnetic material 30, for example such that includes neodymium-iron-boron, may undergo processing including preparing formula powder, melting, milling, pressing, sintering, machining, plating, magnetization, inspection, and/or other steps. Smelted neodymium-iron-boron alloy ingots may be transformed into particle form, for example by powder metallurgy process, and may be oriented and formed in the magnetic field. The molding embryo may be sintered in an inert gas or vacuum to densify it, which may result in a sintered neodymium-iron-boron material with a very high magnetic energy product and coercivity, cost-effective production, and good mechanical structure. Sintered neodymium-iron-boron magnets may be rated according to maximum energy product.

Neodymium magnets, and especially magnets including neodymium-iron-boron may be desirable due to their relatively strong magnetic field given the amount of material required to achieve a desired level of magnetic attraction, promoting considerable efficiency. For at least these reasons, inclusion of rare-earth magnets, such as neodymium-iron-boron magnets, in a hair accessory may advantageously allow a wearer to benefit from various magnetically-attachable hair products and services while decreasing damage to the customers hair, decreasing the time required to apply the products, and reducing the steps associated to the installation.

The magnetic material 30 may additionally include one or more additives. For example, cobalt may be included to increase tolerance for high temperature. In another example, dysprosium may be included to increase the intrinsic coercivity of the magnetic material 30.

Additional materials may be included, such as cobalt. For the purpose of this disclosure, cobalt is intended to include cobalt alloys, such as samarium cobalt. For example, samarium cobalt may be created from samarium, cobalt, and iron. The majority element in the compound may be iron. Magnetic material 30 including samarium cobalt may advantageously permit higher temperature applications, where the strength of rare-earth magnets may be maintained in such applications. Magnetic material 30 including cobalt may have a higher Curie temperature than does neodymium but are typically also costlier to manufacture. For example, a magnetic material 30 may benefit from inclusion of a cobalt alloy to enhance temperature tolerance of at least 40 degrees Celsius, or approximately sufficient to withstand the heat produced by a hair dryer.

Another material that may be added to the magnetic material 30 may include dysprosium. Dysprosium has high magnetic susceptibility, providing considerably high magnetic strength even at low temperatures. Dysprosium can also have paramagnetic properties at temperatures above about 179 K. Magnetic materials 30 including neodymium-iron-boron may also include dysprosium as a substitute for a portion of the neodymium. The inclusion of dysprosium can raise the magnetic coercivity and improve corrosion resistance.

The coating will now be discussed in greater detail. FIGS. 1-7 highlight examples of the coating 40, which may also be shown in other figures. The coating 40 may be formed using one or more materials capable of substantially surrounding the magnetic materials 30 and positioning the magnetic materials 30 close to the hair material base end 21 of the hair material 20. The coating 40 may additionally bond the hair material 20 to an attachment interface in some embodiments.

The coating 40 may be provided by a reaction polymer. Skilled artisans will appreciate reaction polymers to include epoxies, unsaturated polyesters, phenolics, and polyurethane. The reaction polymer may be a thermosetting polymer, providing advantageous benefits of high resistivity to melting or deformation when heated.

In one embodiment, the coating 40 may be formed from or include polyurethane. Those of skill in the art will appreciate that polyurethane as a polymer with organic units joined by urethane links. For the purpose of this disclosure, both thermosetting and thermoplastic polyurethane variants are intended to be included in the broader definition of polyurethane, without limitation. However, because of the benefits provided from high resistivity to melting or deformation when heated, thermosetting polyurethanes may provide additional advantages over thermoplastic polyurethanes. In one embodiment, the application of a polyurethane-based coating 40 may be performed in a substantially moisture-free environment to reduce the chance of foaming.

The coating 40 may be applied at the hair material base end 21 of the hair material 20 such that it also substantially encompasses at least some of the magnetic material 30. In this application, the coating 40 may advantageously hold the magnetic attraction properties of the magnetic material 30 near the hair material base end 21 of the hair material 20. The coating 40 may additionally benefit the hair accessory 10 by providing corrosion resistance to the magnetic material 30 held by the coating 40.

In at least one embodiment, additional features may be provided on the coating 40 to increase the gripping capability of the hair accessory 10. For example, one or more scores 80 may be applied to the coating to increase the friction between the coating 40 and a mounting location 70 that the hair accessory 10 is installed to, also increasing the grip of the hair accessory 10 to the mounting location 70. The score 80 is also intended to include stippling, hatching, and other features that would be apparent to a person of skill in the art after having the benefit of this disclosure. Additional grip enhancing features may include application of additional material such as sand, silica, or other materials that can enhance the friction to the mounting location 70 or otherwise resist slipping. The additional features to enhance grip may be included in a way as to minimize irritation to the wearer.

The active face and neutral face will now be discussed in greater detail. FIG. 2 highlights examples of the active face 50 and neutral face 60, which may also be shown in other figures. The active face 50 may provide enhanced magnetic attractive properties such to draw near other active faces 52 of other hair accessory 12 pieces. The active face may include an arrangement of magnetic material 30 such to promote high magnetic activity, such as by providing staggered or directed magnetic poles. For example, the poles of the magnets may be aligned such to improve the strength of the attractive force of the active face 30.

The neutral face 60 may be positioned approximately opposite to the active faced 50. The neutral face 60 may feature reduced magnetic activity to mitigate attracting undesired objects such as hair clips and bobby pins. The neutral face 60 may include an arrangement of magnetic material 30 such as to minimize the wandering flux of the hair accessory 10, reducing the magnetic attraction of the magnetic material 30 in the direction of the neutral face 60. Skilled artisans will appreciate that additional locations, orientations, and properties of the active face 50, neutral face 60, and/or various intermediate faces are intended to be included within the scope of this disclosure, without limitation.

Figure 7:
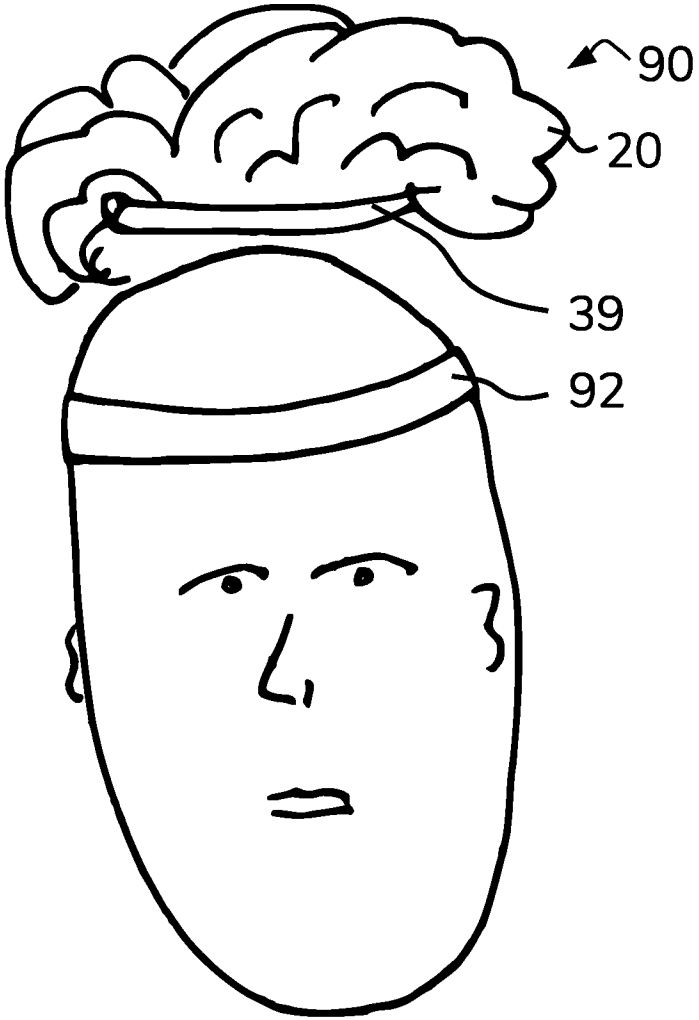
FIG. 7 is a front elevation view of a hair accessory installable to the head of a wearer, according to an embodiment of this disclosure.

The mounting location will now be discussed in greater detail. FIGS. 2 and 7 highlight examples of the mounting location 70, which may also be shown in other figures. The mounting location 70 may be provided as virtually any place onto which the hair accessory 10 may be installed. For example, the mounting location 70 may include the natural hair of the wearer onto which the hair accessory 10 may be installed. In another embodiment, the mounting location may be provided by an artificial surface or structure onto which the hair accessory 10 may be installed.

An example with a mounting location 70 being the actual hair growing from a wearer will now be discussed along with FIG. 2, without limitation. The hair accessory 10 may install to the mounting location 70 via compression of multiple pieces of the hair accessory 10 about various portions of the mounting location 70. In this example, the hair accessory 10 may work with one or more other hair accessory 12 to mount to the mounting location 70, such as the hair of a wearer.

This example features a hair accessory 10 that may include hair material 20 and magnetic material 30. The magnetic material 30 may be at least partially held in place about a hair material base end of the hair material 20 by a coating 30. The coating 30 may have an active face 50 facing inwardly towards the mounting location 70 and a neutral face 60 facing outwardly away from the mounting location 70.

This example also features another hair accessory 12 that may include hair material 22 and magnetic material 32. The magnetic material 32 may be at least partially held in place about a hair material base end of the hair material 22 by a coating 32. The coating 32 may have an active face 52 facing inwardly towards the mounting location 70 and a neutral face 62 facing outwardly away from the mounting location 70.

The active face 50 of the hair accessory 10 and the other active face 52 of the other hair accessory 12 may attract towards each other from the attractive force of the magnetic material 30 held by the coating 40 of the hair accessory 10 and the other magnetic material 32 and held by the other coating 42 of the other hair accessory 12. Additional features such as scoring or grit may enhance the security of the installation for the hair accessories 10, 12 to the mounting location 70. This installation may be supplemented or assisted by additional installation techniques such as adhesive, weave, and other traditional techniques and is not intended to exclude its operation from working with any other hair supplementing procedures.

Figure 3:
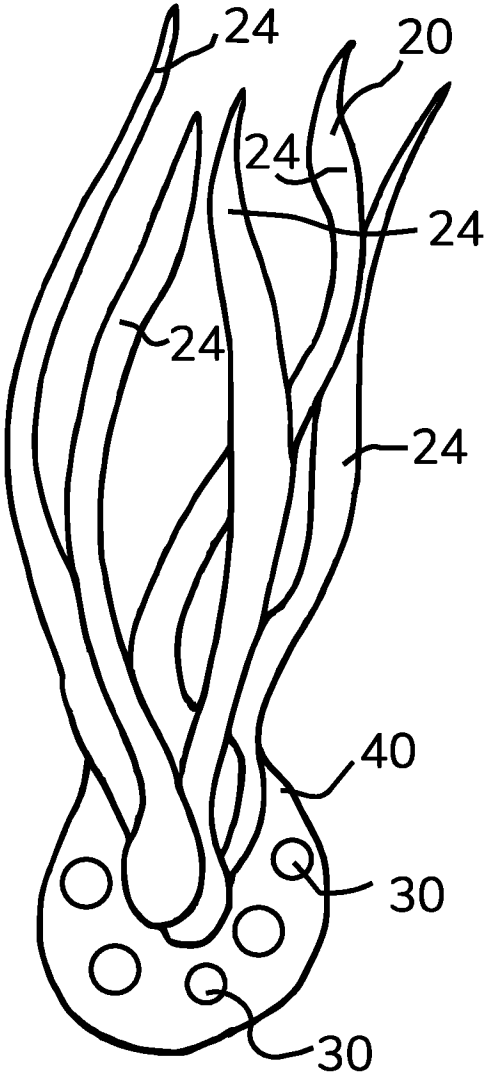
FIG. 3 is a front elevation view of a magnetic hair accessory with multiple hair strands, according to an embodiment of this disclosure.

Referring now to FIG. 3, an embodiment of the hair accessory with multiple hair strands will now be discussed, without limitation. The embodiment shown in FIG. 3 displays hair material 20 that includes multiple hair strands 24. Skilled artisans will appreciate that the number of hair strands 24 shown in FIG. 3 are provided for illustrative purposes only and is not intended to limit the upper or lower quantity of hair strands 24 that may be included in the hair material 20. The hair strand base ends of each of the hair strands 24 may collectively form the hair material base end. Coating 40 may be applied about the hair material base end of the hair material 20, in which magnetic material 30 may be included.

Figure 4:
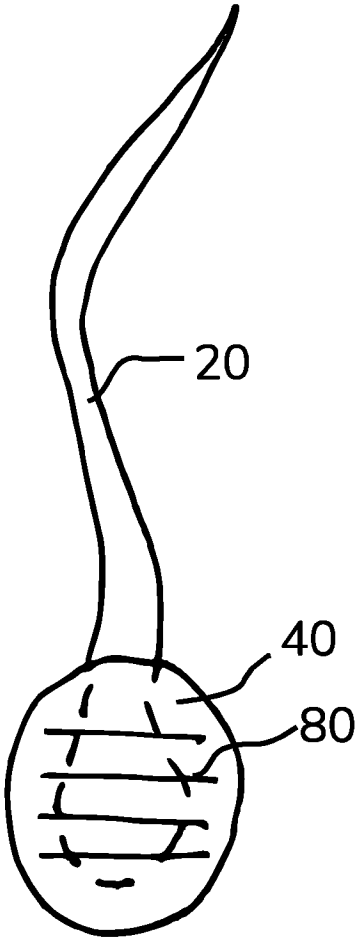
FIG. 4 is a front elevation view of a magnetic hair accessory with a score, according to an embodiment of this disclosure.

Referring now to FIG. 4, an embodiment of the hair accessory with at least one score will now be discussed, without limitation. In this embodiment, the hair material 20 may include a coating 40 at the hair material base end. The coating may include one or more scores 80, which may help to improve the friction against a mounting location 70 and increase the grip of the hair accessory 10 for the installation. Magnetic material may be included in the coating.

Figure 5:
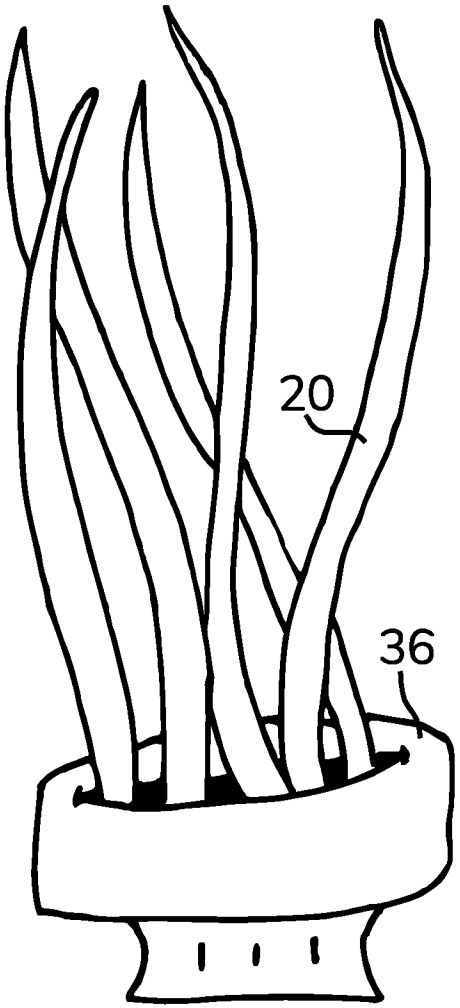
FIG. 5 is a front elevation view of a hair accessory with a magnetic clip, according to an embodiment of this disclosure.

Referring now to FIG. 5, an embodiment of the hair accessory with a magnetic clip illustrative attachment interface will now be discussed, without limitation. In this embodiment, the hair material may be substantially secured in a clip 36, which may have magnetic properties. For example, the clip 36 may include magnetic material. Optionally, the hair material 20 may be inserted into one end of the clip 36 to a desired length. The clip 36 may then be crimped, substantially securing the hair material 20 into the clip 36. The clip 36 may then be installed to the mounting location 70, such as the hair of a user. Optionally, one or more actual hairs of the user may also be passed through the clip 36 with the hair material 20, in the same or opposing directions, to enhance the installation strength of the hair accessory 10.

Figure 6:
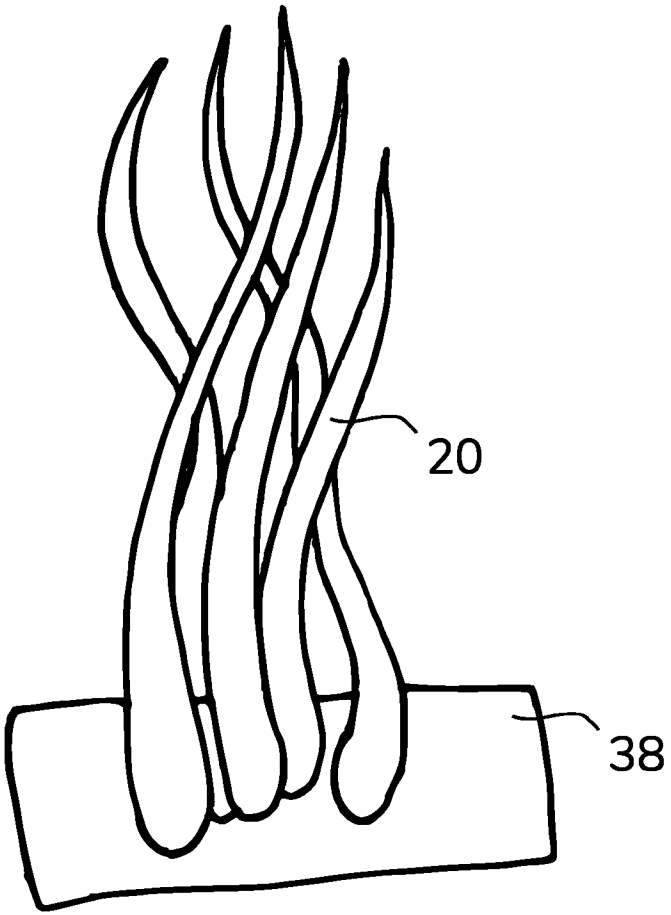
FIG. 6 is a front elevation view of a hair accessory with a magnetic strip, according to an embodiment of this disclosure.

Referring now to FIG. 6, an embodiment of the hair accessory with a magnetic strip illustrative attachment interface will now be discussed, without limitation. In this embodiment, the hair material may be substantially secured to a strip 38, which may have magnetic properties. For example, the strip 38 may include magnetic material. Optionally, the hair material 20 may be located on one or more surface of the strip 38 and secured, for example by the coating 40, adhesion, and/or welding. The strip 38 may then be installed to the mounting location 70, such as the hair of a user, by compressing the features of the mounting location 70 between multiple strips 38. Optionally, one or more actual hairs of the user may also be passed through the strip 38 with the hair material 20 mounted to the strip 38 to enhance the installation strength of the hair accessory 10.

The top piece and magnetic band will now be discussed in greater detail. FIG. 7 highlights examples of the top piece 90 and magnetic band 92, which may also be shown in other figures. Skilled artisans will appreciate the nature of top pieces, wigs, and other hair supplemental products intended to cover the scalp of a user or other location with a low number of grown hairs onto which a hair accessory may mount. Skilled artisans will additionally appreciate that this example should not be limited to only applications with top pieces, but also may include hair extensions, partials, wigs, frontals, hair replacement pieces, and other related hair objects and devices that will be apparent after the benefit of this disclosure. Optionally, the magnetic band 92 and/or a cap may be sold in variations with or without hair installed to it.

In this embodiment, hair material 20 may be mounted to or extend outwardly from the top piece 90 and/or other hair piece. Additionally, a magnetic border 39, which may also be provided by pockets of magnetized material, may be included on the top piece 90 and/or other hair piece. For example, the magnetic border 39 may substantially surround at least part of the perimeter of the top piece 90 and/or other hair piece. Additionally, a wearer may place a magnetic band 92 around a portion of their head or other location onto which the top piece 90 and/or other hair piece may be installed. The magnetic band 92 may be at least partially secured to the wearer via adhesive, tape, elasticity, compression, and/or other techniques that would be apparent to a person of skill in the art after having the benefit of this disclosure. To install the top piece 90 and/or other hair piece, the wearer may then place the top piece onto their head to allow the magnetic border 38 of the top piece 90 and/or other hair piece to magnetically attract to the magnetic band 92 worn by the wearer. Optionally, additional hair material may be installed to the hair material extending from the top piece similar to the techniques discussed in the various examples above.

Figure 9:
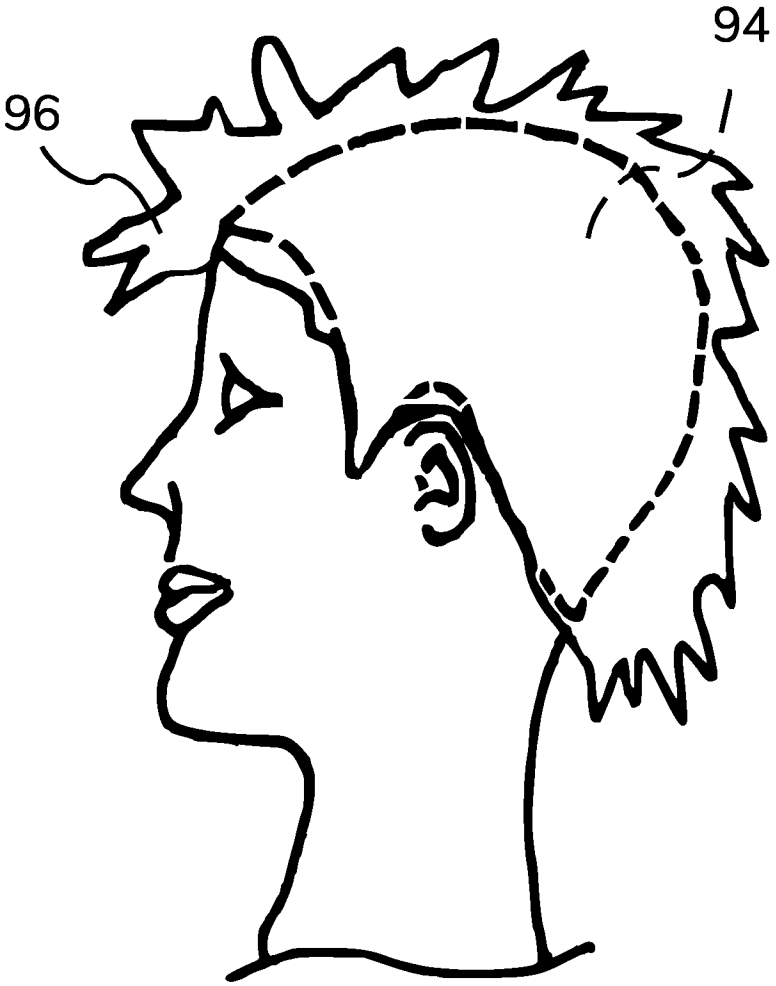
FIG. 9 is a side elevation view of a hair accessory installable to the head of a wearer, according to an embodiment of this disclosure.
Figure 8:
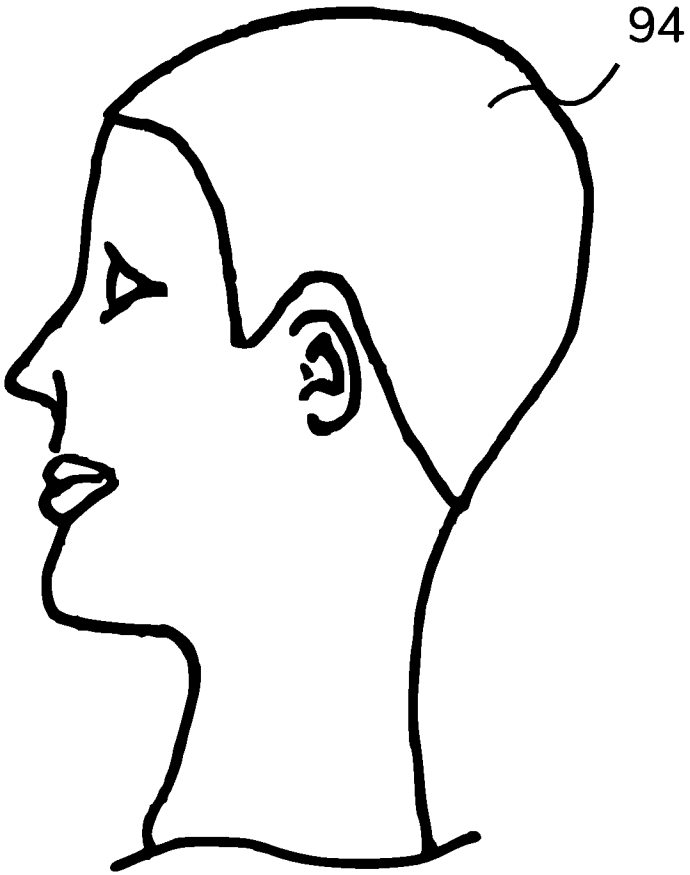
FIG. 8 is a side elevation view of a hair accessory installable to the head of a wearer, according to an embodiment of this disclosure.

An embodiment including an illustrative cap and cap-installable wig will now be discussed in greater detail. FIGS. 8-9 highlight examples of the cap-installable wig 96 and cap 94, which may also be shown in other figures. Skilled artisans will appreciate the nature of top pieces, wigs, and other hair supplemental products intended to cover the scalp of a user or other location with a low number of grown hairs onto which a hair accessory may mount. Skilled artisans will additionally appreciate that this example should not be limited to only applications with wigs, but also may include hair extensions, partials, top pieces, frontals, hair replacement pieces, and other related hair objects and devices that will be apparent after the benefit of this disclosure. Optionally, the cap 94 may be sold in variations with or without hair installed to it.

In this embodiment, hair material may be mounted to or extend outwardly from the cap-installable wig 96 and/or other hair piece. Additionally, a magnetic border, which may also be provided by pockets of magnetized material, may be included on the cap-installable wig 96 and/or other hair piece. For example, the magnetic border may substantially surround at least part of the perimeter of the cap-installable wig 96 and/or other hair piece. Furthermore, magnetic material may be placed about other locations on the surface of the cap 94, to which a cap-installable wig 96 and/or other hair piece maybe removably installed. The cap 94 may be at least partially secured to the wearer via adhesive, tape, elasticity, compression, and/or other techniques that would be apparent to a person of skill in the art after having the benefit of this disclosure. To install the cap-installable wig 96 and/or other hair piece, the wearer may then place the wig onto their head to allow the magnetic material of the cap-installable wig 96 and/or other hair piece to magnetically attract to a portion of the cap 94 worn by the wearer. Optionally, additional hair material may be installed to the hair material extending from the top piece similar to the techniques discussed in the various examples above.

Figures 10, 11, 12:
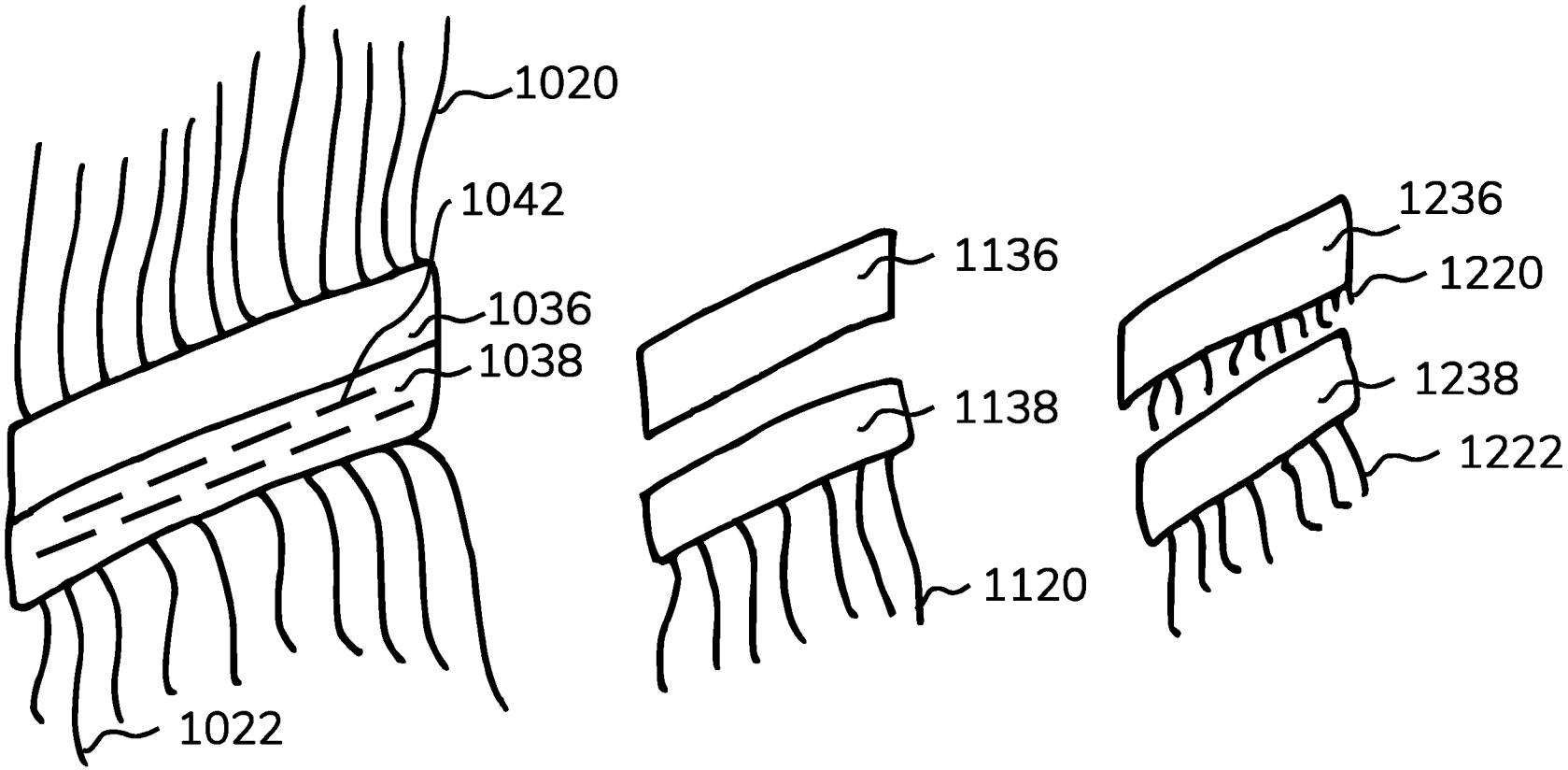
FIGS. 10-12 are perspective views of a hair accessory installable to the head of a wearer, according to an embodiment of this disclosure.

An embodiment including at least one addition hair strip with addition hair material will now be discussed, without limitation. FIG. 10 highlights an example of the hair accessory with an addition strip 1036 and connected addition hair material 1020. In this embodiment, the addition hair material 1020 may be substantially secured to the addition strip 1036, which may have magnetic properties. For example, the addition strip 1036 may include magnetic material. In some embodiments, magnetic properties may be also additionally included with the hair material 1020. A second addition strip 1038 may also be provided with associated second addition hair material 1022, which may also have magnetic properties. The second addition strip 1038 may include addition perforations 1042, through which user hair and/or synthetic hair may be passed, woven, or otherwise connected.

Optionally, the addition hair material 1020 may be located on one or more surface of the addition strip 1036 and secured, for example by a coating, adhesion, and/or welding. In this example, the second addition hair material 1022 may be located on one or more surface of the second addition strip 1038 and secured, for example by a coating, adhesion, and/or welding. The addition strip 1036 may then be installed to a mounting location, such as the hair of a user, by compressing the features of the mounting location between the first addition strip 1036 and the second addition strip 1038. Optionally, one or more actual hairs of the user may also be passed through the addition perforations 1042 of the second addition strip 1038 to advantageously enhance the installation strength of the hair accessory.

An alternative embodiment including at least one addition hair strip with addition hair material will now be discussed, without limitation. FIG. 11 highlights an example of the hair accessory with a first addition strip 1136 and a second addition strip 1138. In this embodiment, the addition strip 1136 may have magnetic properties. For example, the addition strip 1136 may include magnetic material. A second addition strip 1138 may also be provided with associated addition hair material 1120, which may also have magnetic properties.

Optionally, the addition hair material 1120 may be located on one or more surface of the addition strip 1138 and secured, for example by a coating, adhesion, and/or welding. The first and second addition strips 1136, 1138 may then be installed to a mounting location, such as the hair of a user, by compressing the features of the mounting location between the first addition strip 1136 and the second addition strip 1138 to advantageously enhance the installation strength of the hair accessory.

Another alternative embodiment including at least one addition hair strip with addition hair material will now be discussed, without limitation. FIG. 12 highlights an example of the hair accessory with an addition strip 1236 and connected addition hair material 1220. In this embodiment, the addition hair material 1220 may be substantially secured to the addition strip 1236, which may have magnetic properties. For example, the addition strip 1236 may include magnetic material. In some embodiments, magnetic properties may be also additionally included with the hair material 1220. A second addition strip 1238 may also be provided with associated second addition hair material 1222, which may also have magnetic properties.

Optionally, the addition hair material 1220 may be located on one or more surface of the addition strip 1236 and secured, for example by a coating, adhesion, and/or welding. In this example, the second addition hair material 1222 may be located on one or more surface of the second addition strip 1238 and secured, for example by a coating, adhesion, and/or welding. The addition strip 1236 may then be installed to a mounting location, such as the hair of a user, by compressing the features of the mounting location between the first addition strip 1236 and the second addition strip 1238 to advantageously enhance the installation strength of the hair accessory.

In one embodiment, a cap with magnetic features may be provided to supplement and/or replace hair of a user. For example, a cap may be provided with natural and/or synthetic hair installed. The cap may be removably installed to a user via magnetics and/or other attachment techniques. For example, silicone or another material may be used to facilitate sticking at least part of the cap to the top portion of a user's head.

In one embodiment, a band may be provided with hair that may be installed against the wig. The hair included by the band may be natural, synthetic, semi-synthetic, and/or a mixture of hair types and sources. The band may include magnetic attachment interfaces. For example, the band may include a magnetic material applied to a significant portion of the circumference of the band on an inner and/or outer surface. In another example, the band may include a magnetic material applied to spaced locations about the circumference of the band on an inner and/or outer surface. A wig, top piece, strips, cap, and/or other hair replacement products may be removably installed to the band, for example, via magnet attraction.

In operation, a method may be provided for supplementing and/or replacing hair using a magnetic hair accessory. Those of skill in the art will appreciate that the following methods are provided to illustrate an embodiment of the disclosure and should not be viewed as limiting the disclosure to only those methods or aspects. Those of skill in the art will appreciate that this and the additional examples given throughout this disclosure may be performed by an individual, professional, and/or other person. Skilled artisans will appreciate additional methods within the scope and spirit of the disclosure for performing the operations provided by the examples below after having the benefit of this disclosure. Such additional methods are intended to be included by this disclosure.

In one example operation, the hair accessory may be installed by locating one piece of the hair accessory near the hair of a wearer. The hair accessory may include hair material and a magnetic material. The hair accessory may be positioned near a mounting location, such as the hair grown by the wearer, so that an active face with attractive magnetic characteristics substantially faces the mounting location. The wearer may then locate at least one other active face of another hair accessory near the active face of the first hair accessory to install the hair material to the mounting location.

The multiple hair accessory pieces may compress the active faces about the mounting location via attraction of the magnetic material included in the coating of each of the hair accessories. The magnetic material may include rare-earth magnets, such as neodymium, to enhance the magnetic attraction while not adding undesirable weight to the hair accessory. Optionally, the grip of the hair accessory to the mounting location may be supplemented by including one or more score, grit, and/or other feature that could improve friction. The score, grit, and/or other feature may be integrated or otherwise provided by the coating.

While various aspects have been described in the above disclosure, the description of this disclosure is intended to illustrate and not limit the scope of the invention. The invention is defined by the scope of the appended claims and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the following claims.

What is claimed is:

1. A hair accessory apparatus comprising:

a plurality of hair accessory pieces, wherein each of the plurality of hair accessory pieces comprise:

hair material comprising a hair material base end and a hair material distal end, a magnetic material operatively installed to the hair material near the hair material base end, and a coating to at least partially enclose the magnetic material and part of the hair material at the hair material base end; and wherein the hair material is installed to a mounting location via compression of the mounting location between two or more of the plurality of hair accessory pieces by the magnetic material included by each of the plurality of hair accessory piece; and wherein the coating comprises:

a score to improve friction and increase grip to the mounting location.

2. The hair accessory apparatus of claim 1, wherein the magnetic material comprises:

magnetic particles substantially located within the coating.

3. The hair accessory apparatus of claim 1, wherein the magnetic material comprises:

rare-earth magnets.

4. The hair accessory apparatus of claim 1, wherein the magnetic material comprises:

neodymium-iron-boron.

5. The hair accessory apparatus of claim 1, wherein the magnetic material further comprises:

cobalt; and wherein the magnetic material is resistant to degradation for up to about 40 degrees Celsius.

6. The hair accessory apparatus of claim 1, wherein the magnetic material further comprises:

dysprosium.

7. The hair accessory apparatus of claim 1, wherein the magnetic material is at least partially bonded to an attachment interface.

8. The hair accessory apparatus of claim 1, further comprising:

an active face magnetically attractable to at least one other active face to install the hair material to the mounting location via at least compression.

9. The hair accessory apparatus of claim 8, further comprising:

a neutral face positioned approximately opposite to the active face and exhibiting minimal wandering flux.

10. The hair accessory apparatus of claim 1, wherein the mounting location comprises natural hair grown by a wearer.

11. The hair accessory apparatus of claim 1, wherein the mounting location comprises a base portion installable to a wearer.

12. The hair accessory apparatus of claim 1, wherein the coating comprises a reaction polymer; and wherein the coating substantially encloses at least part of the magnetic material at the hair material base end.

13. The hair accessory apparatus of claim 12, wherein the reaction polymer comprises polyurethane.

14. The hair accessory apparatus of claim 1, wherein the coating further comprises additional grip enhancing features provided by application of additional material that enhance friction to the mounting location.

15. The hair accessory apparatus of claim 14, wherein the additional material of the additional grip enhancing features comprises sand, silica, and/or grit.

16. The hair accessory apparatus of claim 1, wherein the coating comprises a thermosetting polyurethane.

17. A hair accessory apparatus comprising:

a plurality of hair pieces;

a magnetic material operatively installed to a hair piece base end of at least two of the plurality of hair pieces;

a coating comprising a reaction polymer that is thermosetting to at least substantially enclose the magnetic material about the hair piece base end;

an active face exhibiting a magnetic attractive force; and a neutral face positioned approximately opposite to the active face;

wherein the active face of at least one of the plurality of hair pieces magnetically attracts at least one other active face to install the at least two of the plurality of hair pieces to a mounting location via being compressed by the active face of the two or more of the plurality of hair pieces located adjacent to the mounting location;

wherein the neutral face exhibits minimal wandering flux;

wherein the coating comprises a score to improve friction and increase grip to the mounting location; and wherein the mounting location comprises hair that is naturally grown from the head of a person.

18. The hair accessory apparatus of claim 17, wherein the magnetic material further comprises:

cobalt and dysprosium;

wherein the reaction polymer comprises polyurethane.

* * * * *